US007303159B2

(12) United States Patent
Hishiyama et al.

(10) Patent No.: US 7,303,159 B2
(45) Date of Patent: Dec. 4, 2007

(54) CRUSHING CONTROL APPARATUS FOR SHEARING CRUSHER

(75) Inventors: Tooru Hishiyama, Hirakata (JP); Toshio Kitani, Hirakata (JP); Eiichi Muramoto, Hirakata (JP); Takuya Uemura, Hirakata (JP); Kazuyuki Yamazaki, Hirakata (JP); Shimpei Abe, Hirakata (JP)

(73) Assignee: Komatsu Ltd., Tokyo (JP)

( * ) Notice: Subject to any disclaimer, the term of this patent is extended or adjusted under 35 U.S.C. 154(b) by 365 days.

(21) Appl. No.: 10/805,618

(22) Filed: Mar. 18, 2004

(65) Prior Publication Data

US 2004/0200911 A1 Oct. 14, 2004

(30) Foreign Application Priority Data

Apr. 9, 2003 (JP) ..... 2003-104792
Aug. 27, 2003 (JP) ..... 2003-302400

(51) Int. Cl.
*B02C 4/32* (2006.01)
*B02B 5/02* (2006.01)

(52) U.S. Cl. ..... 241/36; 241/101.3

(58) Field of Classification Search ..... 241/101.01, 241/101.03, 101.3, 33–37
See application file for complete search history.

(56) References Cited

U.S. PATENT DOCUMENTS 4,635,858 A 1/1987 Welch et al.
4,793,561 A * 12/1988 Burda ..... 241/36
5,050,807 A * 9/1991 Backstrom et al. .... 241/101.01
5,653,393 A 8/1997 Tanaka et al.
5,765,765 A 6/1998 Tamura et al.
5,803,376 A 9/1998 Koyanagi et al.
5,901,535 A 5/1999 Duckinghaus et al.
6,182,914 B1 2/2001 Carle
6,474,577 B2 11/2002 Ikegami et al.
6,836,089 B2 12/2004 Siebert
2003/0141394 A1* 7/2003 Ueda et al. ..... 241/73

(Continued)

FOREIGN PATENT DOCUMENTS

DE 29 37 846 C2 3/1981

(Continued)

OTHER PUBLICATIONS

English translation of Japanese Office Action dated Jun. 20, 2007 issued in a counterpart Japanese application No 2003-302400, 2 pages.

*Primary Examiner*—Faye Francis
(74) *Attorney, Agent, or Firm*—Frishauf, Holtz, Goodman & Chick, P.C.

(57) ABSTRACT

A crushing control apparatus for a shearing crusher, which properly controls the crusher in accordance with kinds of objects to be crushed and is capable of reliably preventing stop of operation due to excessive load, clogging and the like, is provided. For this purpose, the crushing control apparatus includes a mode selecting switch (59) for selecting a mode according to each kind of the objects to be crushed, a ROM (33*a*) for storing a control condition of the rotary shafts (11, 11), which conforms to the mode for each of the mode, and a controller (33), which reads out the control condition corresponding to a selected mode from the ROM, when the predetermined mode is selected by the mode selecting switch, and controls the rotary shafts to be in the control condition which is read out.

4 Claims, 9 Drawing Sheets

U.S. PATENT DOCUMENTS

| | | | | |
|---|---|---|---|---|
| 2004/0155128 | A1* | 8/2004 | Ikegami et al. | 241/36 |
| 2004/0200914 | A1 | 10/2004 | Hishiyama et al. | |

FOREIGN PATENT DOCUMENTS

| | | | |
|---|---|---|---|
| DE | 3412306 | C2 | 10/1985 |
| DE | 195 18 390 | C2 | 11/1996 |
| GB | 2 062 496 | A | 5/1981 |
| JP | 11-68363 | A | 7/1989 |
| JP | 04-269153 | A | 9/1992 |
| JP | 8-047651 | A | 2/1996 |
| JP | 2628054 | B2 | 7/1997 |
| JP | 11-033424 | A | 2/1999 |
| JP | 2000-070752 | A | 3/2000 |
| JP | 2000-325823 | A | 11/2000 |
| JP | 2001-070810 | A | 3/2001 |
| JP | 2002-79135 | A | 3/2002 |
| JP | 2002-219379 | A | 8/2002 |
| KR | 160863 | B1 | 11/1998 |

* cited by examiner

FIG. 9

| OBJECTS TO BE CRUSHED | STRAW MATTING | TIRE | PALLET |
|---|---|---|---|
| CRUSHER ROTATIONAL SPEED | FIXED AT LO | FIXED AT LO | AUTO SPEED CHANGE |
| CRUSHER NORMAL ROTATION TIME (sec) | 30 | 60 | 60 |
| CRUSHER REVERSE ROTATION TIME (sec) | 5 | 5 | 5 |

CRUSHING CONTROL APPARATUS FOR SHEARING CRUSHER

TECHNICAL FIELD

The present invention relates to a crushing control apparatus for a shearing crusher, which is used for crushing waste building materials, waste home electric appliances and the like, and shears and crushes objects to be crushed by cutters by rotating rotary shafts having the cutters.

BACKGROUND ART

In demolishing sites, waste sites for home electric appliances and the like, a self-propelled crushing machine for crushing for crushing objects to be crushed such as waste building materials and waste home electric appliances is used conventionally. As for this crushing machine, the one with a structure, in which a crusher, a hopper and a power source are provided on a vehicle body including a set of left and right track type carriers and a discharge conveyor is provided between the left and right carriers to be able to be raise and lowered, is generally used. In this self-propelled crushing machine, the objects to be crushed which are charged into the hopper is crushed into pieces, and the crushed pieces are discharged onto the discharge conveyor from a discharge port provided at a bottom portion of the crusher and are transferred to an outside of the vehicle body by this discharge conveyor.

The crusher loaded on the aforesaid crushing machine is constructed to include a hydraulic pump driven by an engine which is the power source, rotationally drive a pair of rotary shafts opposing each other with a hydraulic motor rotated by discharge pressure oil of this hydraulic pump as a driving source, and crush an object to be crushed by sandwiching it between cutters which are attached to the rotary shafts.

As a prior art, Japanese Patent Laid-open No. 2002-79135 is known. The self-propelled crushing machine disclosed in Japanese Patent Laid-open No. 2002-79135 includes a crusher for crushing objects to be crushed, a working machine such as a feeder for supplying the objects to be crushed to this crusher, and a carrier apparatus. Selection means for making it possible to select a working mode for performing a crushing work by the working machine, a traveling mode for performing traveling by the carrier apparatus, and an adjustment mode for performing a clearance adjustment of a crushing section of the crusher is provided, so that the operation by the working mode and the traveling mode is made invalid when the adjustment mode is selected.

Incidentally, as the objects to be crushed which are processed especially by a shearing crusher among this type of crushers, there are actually various kinds of objects such as an objects which comparatively has tenacity as a tire and easily clogged, an object, which is light load and easily tangled as straw matting, an object of light load such as a wooden pallet, an object which is hard such as home electric appliances made of iron, and the like. However, in the conventional shearing crushers, the optimal control in accordance with the kinds of the objects to be crushed is not performed. Consequently, there arises the problem that when, for example, the objects to be crushed easily clogged is charged, clogging occurs and the operation of the crusher is stopped due to excessive load, thus causing reduction in the working efficiency.

SUMMARY OF THE INVENTION

The present invention is made to solve the above-described problem, and has its object to provide a crushing control apparatus for a shearing crusher, which reliably prevents stop of an operation due to excessive load, clogging and the like by controlling the crusher properly in accordance with kinds of objects to be crushed, and thereby is capable of enhancing working efficiency.

In order to attain the above-described object, the crushing control apparatus for the shearing crusher according to the present invention is: a crushing control apparatus for a sharing crusher for shearing and crushing objects to be crushed with cutters by rotating rotary shafts having the cutters; and comprises: mode selecting means for selecting a mode according to each kind of the objects to be crushed; memory means for storing a control condition of the rotary shafts, which conforms to the mode, for each of the mode; and control means, which reads out the control condition corresponding to a selected mode from the memory means, when the predetermined mode is selected by the mode selecting means, and controls the rotary shafts to be in the control condition which is read out.

According to the above constitution, when the mode according to the kinds of the objects to be crushed such as a hard object, a soft object, a tenacious object, and a long object, for example, is selected by the mode selection means, the control condition of the rotary shafts for each mode previously stored in the memory means is read out, and the rotary shafts are controlled to be always in the control condition by the control means. The rotary shafts of the shearing crusher is always controlled under the optimal crushing condition in accordance with the kinds of the objects to be crushed, the stop of operation due to excessive load, clogging and the like can be reliably prevented, thus making it possible to enhance the working efficiency.

In the crushing control apparatus: it is preferable that the mode selecting means selects any one kind of object to be crushed from straw matting, a tire, and a pallet; and the control means controls a hydraulic motor for driving the rotary shafts. According to this constitution, any kind from straw matting or a tire which has a comparatively large clogging factor, and a pallet which is wood of low load with comparatively favorable crushability can be selected by the mode selection means. Consequently, the operation of the operator is simple and easy, and the stop of operation can be reliably prevented.

In the crushing control apparatus: it is preferable that a direction control valve for switching a normal and a reverse rotation directions of the hydraulic motor is further included; and the control means controls a position of the direction control valve and a holding time in the position. According to this constitution, not only the rotational speed of the rotary shafts, but also the normal and reverse rotation directions of the rotary shafts can be switched at each predetermined time on the occasion of crushing a tenacious object. As a result, even when clogging occurs in the shearing crusher, the clogged objects to be crushed or crushed objects can be sheared and crushed again or dropped and discharged from the shearing crusher, and therefore the working efficiency can be further enhanced.

BRIEF DESCRIPTION OF THE DRAWINGS

FIG. 6A is a mode according to objects to be crushed selection menu screen, and FIG. 6B is a tire mode screen;

FIG. 7A is a straw matting screen, and FIG. 7B is a pallet mode screen;

FIG. 9 is a map concerning the objects to be crushed, which is stored in a read only memory.

BEST MODE FOR CARRYING OUT THE INVENTION

A preferred embodiment of a crushing control apparatus for a shearing crusher according to the present invention will be explained with reference to the drawings.

Figure 1:
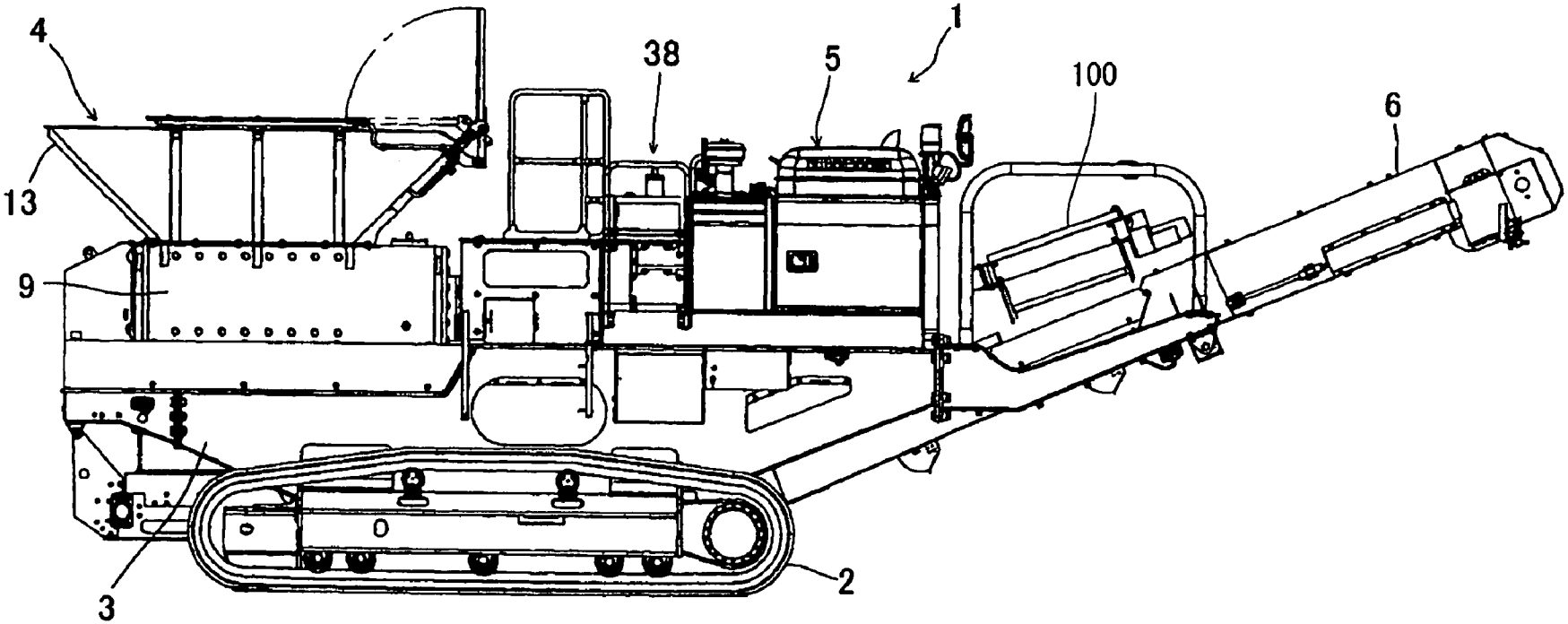
FIG. 1 is a front view of a self-propelled type crushing machine loaded with a shearing crusher according to an embodiment of the present invention.
Figure 2:
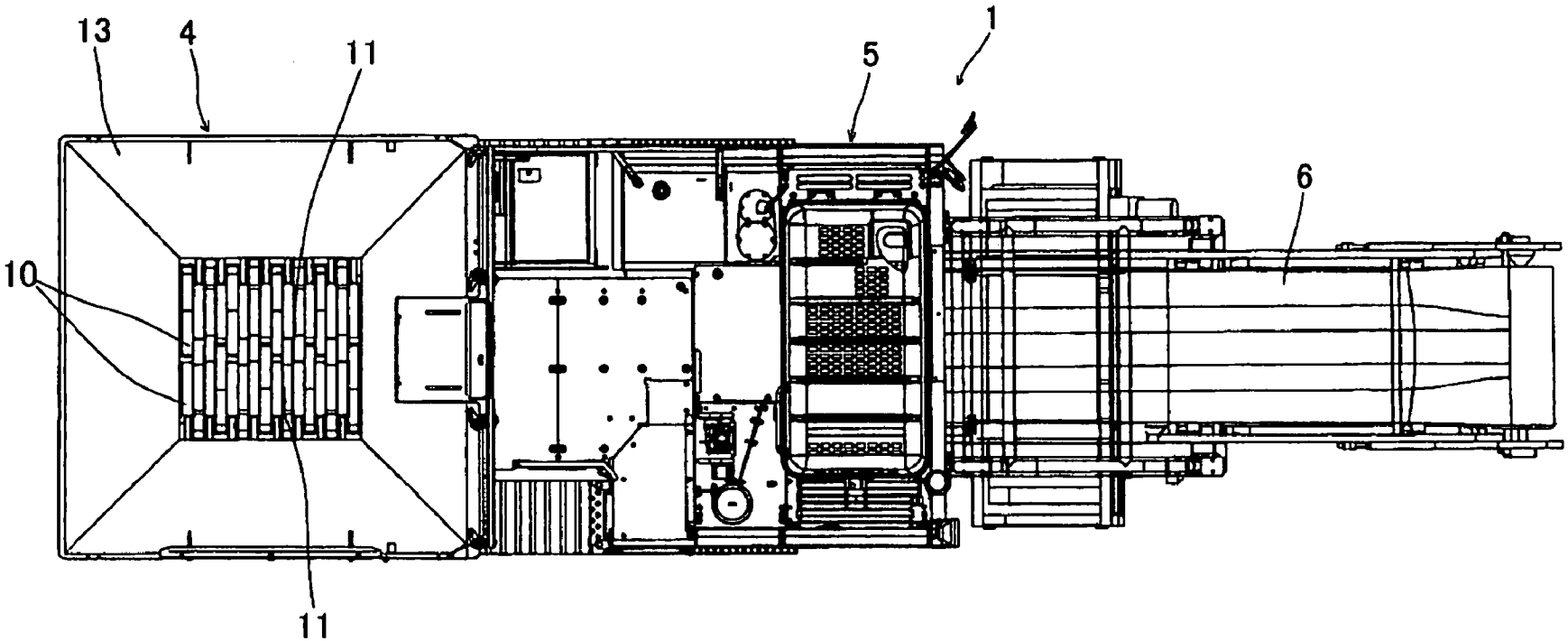
FIG. 2 is a plan view of the self-propelled crushing machine in FIG. 1.

In FIG. 1 and FIG. 2, a self-propelled crushing machine 1 of this embodiment includes a vehicle body 3 including a set of left and right track type carriers 2, a crusher 4 mounted to an area near one end portion in a longitudinal direction on the vehicle body 3, a power unit 5 mounted to an area near the other end portion in the longitudinal direction on the vehicle body 3, a discharge belt conveyor 6 provided between the left and right carriers 2, a cab seat 38 provided between the crusher 4 and the power unit 5, and a magnetic separator 100 provided above the discharge belt conveyor 6, at an outer side in the longitudinal direction from the power unit 5. Here, the power unit 5 includes an engine 7 (see FIG. 3), a hydraulic pump 8 (see FIG. 3) driven by the engine 7. The vehicle body 3 includes a hydraulic pressure control valve and the like for controlling oil from the hydraulic pump 8.

The crusher 4 is a biaxial shearing type in which a pair of rotary shafts 11 having cutters 10 are rotatably supported horizontally in the housing 9, and the pair of rotary shafts 11 are constituted to be rotationally driven by a hydraulic motor 12 driven by the hydraulic pump 8. A hopper 13 is mounted to an upper part of the housing 9, so that the objects to be crushed are charged from a charging port at an upper portion of the hopper 13. The objects to be crushed charged into the hopper 13 are sheared and crushes by the rotation of a pair of rotary shafts 11, and the crushed pieces are dropped on the belt conveyor 6 from an exhaust port formed on a bottom plate of the housing 9 and discharged.

Figure 3:
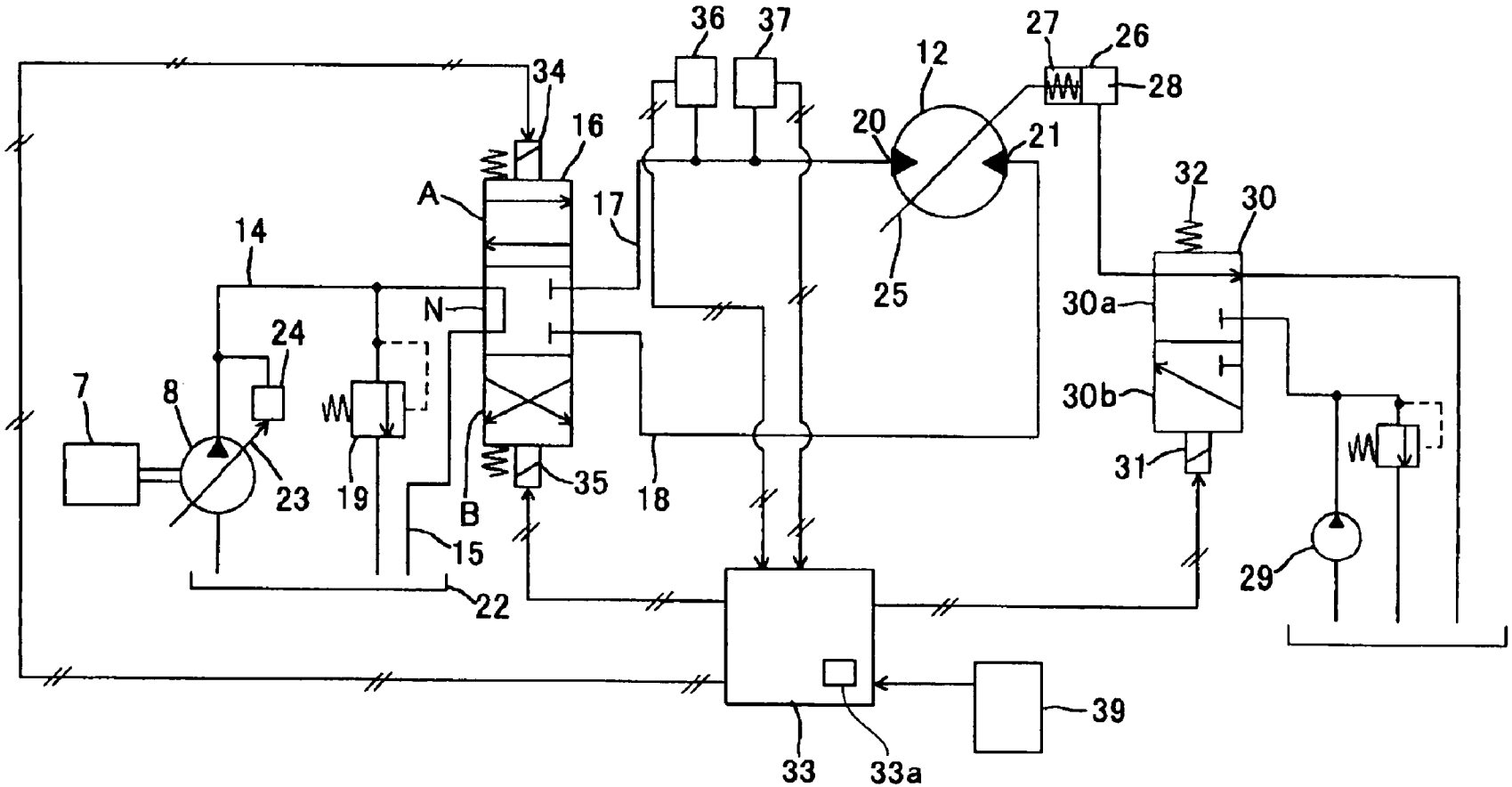
FIG. 3 is a control system block diagram of the shearing crusher according to the embodiment.

As shown in a control system block diagram in FIG. 3, a discharge oil passage 14 and a return oil passage 15 of he hydraulic pump 8 driven by the engine 7 are connected to either a first main circuit 17 or a second main circuit 18 via a direction control valve 16, and discharge pressure from the discharge oil passage 14 is constituted to be adjusted at predetermined pressure by a relief valve 19. The first main circuit 17 is connected to a normal rotation port 20 of the hydraulic motor 12, and the second main circuit 18 is connected to a reverse rotation port 21 of the hydraulic motor 12.

Thus, when the direction control valve 16 is switched to a normal rotation position A from a neutral position N in the drawing, the pressure oil from the discharge oil passage 14 is supplied to the normal rotation port 20 of the hydraulic motor 12 via the first main circuit 17. With this, the pressure oil discharged from the reverse rotation port 21 is returned to a tank 22 via the second main circuit 18, the direction control valve 16 and the return oil passage 15, whereby the hydraulic motor 12 is normally rotated. On the other hand, when the direction control valve 16 is switched to the reverse rotation position B, the pressure oil from the discharge oil passage 14 is supplied to the reverse rotation port 21 of the hydraulic motor 12 via the second main circuit 18. With this, the pressure oil discharged from the normal rotation port 20 is returned to the tank 22 via the first main circuit 17, the direction control valve 16 and the return oil passage 15, whereby the hydraulic motor 12 is reversely rotated.

The hydraulic pump 8 is a variable displacement pump which controls the capacity by changing a tilting angle of a swash plate 23, and the tilting angle of the swash plate 23 is changed by a capacity control member 24 such as a servo cylinder. The capacity of the hydraulic pump 8 is controlled so that the product of pressure and a discharge flow amount per one rotation, namely, absorption torque becomes constant. The hydraulic motor 12 is a variable displacement motor for controlling the capacity by changing a tilting angle of a swash plate 25, and the tilting angle of the swash plate 25 is controlled by a cylinder 26 as a capacity control member. The cylinder 26 is biased in the direction in which the tilting angle of the swash plate 25 becomes large by a spring 27 included therein, and when the pressure oil is supplied into a pressure receiving chamber 28, the cylinder 26 is operated in the direction in which the tilting angle of the swash plate 25 becomes small.

Discharge oil pressure from a control hydraulic pump 29 is supplied to the pressure receiving chamber 28 of the cylinder 26 via a change-over valve 30. When a solenoid 31 is not energized, the change-over valve 30 is in a drain position 30*a* (position shown in the drawing) by a biasing force of a spring 32 to make the tilting angle of the swash plate 25 large (rotational speed of the crusher =Lo: low speed). On the other hand, when the solenoid 31 is energized, the change-over valve 30 is in a supply position 30*b* against the biasing force of the spring 32 to make the tilting angle of the swash plate 25 small (the rotational speed of the crusher =Hi: high speed). In this manner, the tilting angle of the swash plate 25 is switched into two stages. The energizing control for the solenoid 31 is performed in accordance with a control signal from a controller 33. The tilting angle of the swash plate 25 may be optionally controlled (for example, continuously) by making the control signal from the controller 33 continuously variable without being limited only to the two-stage switching.

The direction control valve 16 is always held in the neutral position N, and when a first solenoid 34 is energized, it is switched into the normal rotation position A, and when a second solenoid 35 is energized, it is switched into the reverse rotation position B. The first solenoid 34 and the second solenoid 35 are controlled in accordance with the control signal from the controller 33. A first pressure sensor 36 for detecting a hydraulic signal at a high pressure side, and a second pressure sensor 37 for detecting a hydraulic signal at a low pressure side are interposed in the first main circuit 17, and an output signal from each of the sensors 36 and 37 is inputted into the controller 33. An operating panel 39 is provided at the cab seat 38 (see FIG. 1), so that an operation instruction signal from the operating panel 39 is inputted into the controller 33.

The controller 33 is constituted of a central processing unit (CPU) for executing predetermined program, a read only memory (ROM) 33*a* for storing various kinds of maps such as a map corresponding to this program and the mode according to the objects to be crushed, a random access memory (RAM) as a working memory necessary to execute this program, and as various kinds of registers, and a timer for measuring the time in this program. The read only memory 33*a* for storing the maps in this embodiment corresponds to the memory means in this invention.

Figure 4:
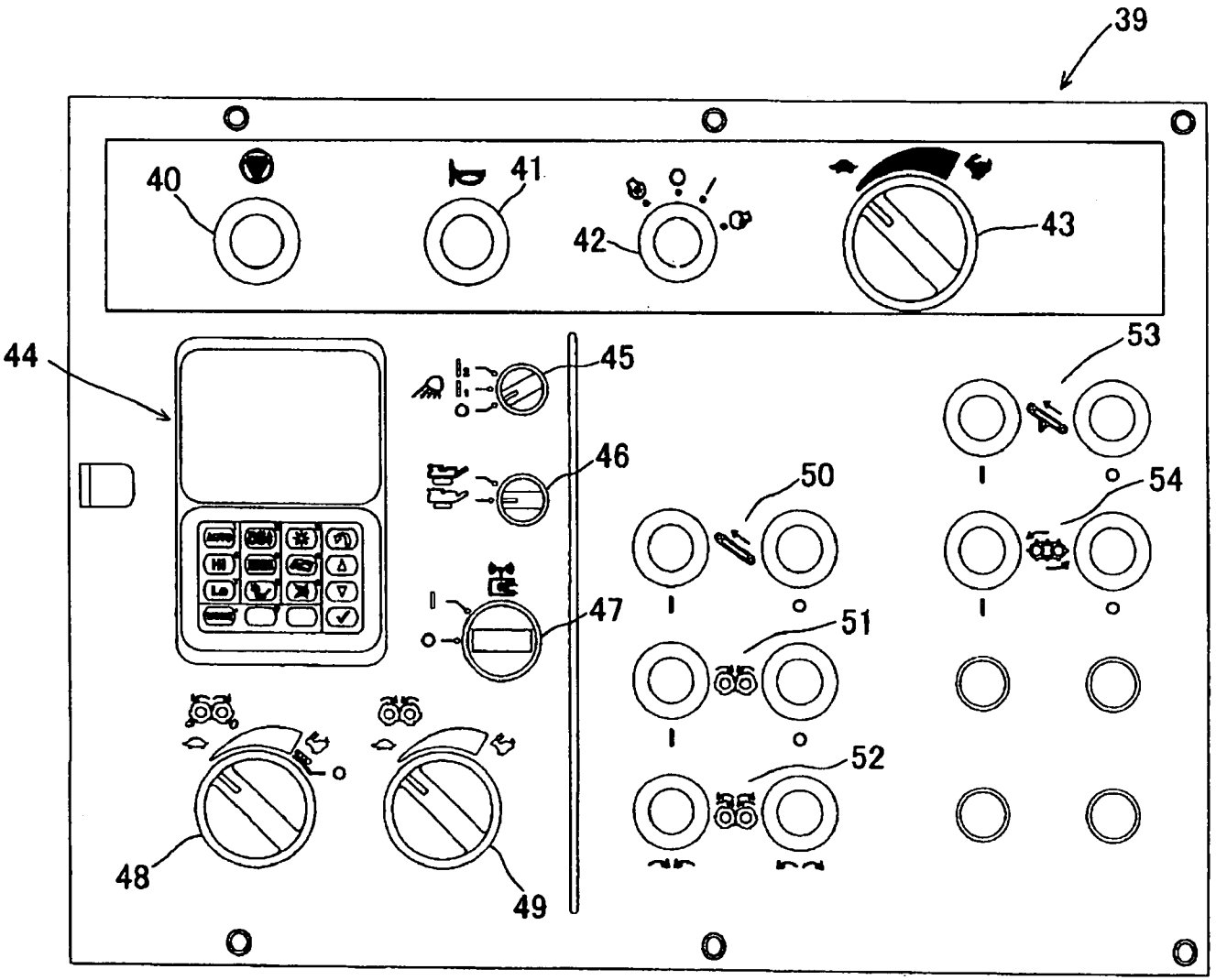
FIG. 4 is a detailed block diagram of an operating panel according to the embodiment.

As shown in FIG. 4, in the operating panel 39, an emergency stop switch 40, a horn switch 41, a key switch 42 and a fuel dial 43 are respectively provided at an upper portion. A multi-monitor 44, a light switch 45, a mode change-over switch 46 for switching to either a working mode or a traveling mode, a radio control change-over switch 47 for switching ON/OFF of the radio control, an automatic cleaning dial 48 for setting the normal rotation time of the rotary shafts 11 to carry out automatic cleaning of the cutters 10, and a crusher speed dial 49 for setting the rotational speed of the rotary shafts 11 are provided at a left side of a lower portion. Further, a conveyor switch 50 for switching ON/OFF of the belt conveyor 6, a crusher automatic operation switch 51 for switching ON/OFF of an automatic operation of the crusher, a crusher manual operation switch 52 for switching ON/OFF of a manual operation of the crusher, a secondary conveyor switch 53 for switching ON/OFF of a secondary conveyor (not shown), a magnetic separator switch 54 for switching ON/OFF of a magnetic separator 100 (see FIG. 1) and the like are respectively provided at a right side of the lower portion.

The multi-monitor 44 includes a monitor screen 55 at an upper portion, and includes various kinds of switches such as a crusher rotation automatic speed change (AUTO) switch 56, a crusher rotation Hi fixing switch 57, a crusher rotation Lo fixing switch 58, mode selecting switch 59 and the like at a lower portion. Nine switches among them are assigned with the functions as numeric keys of 1 to 9. As the aforesaid numeric keys, the assigned number is displayed at a portion of a right shoulder of each of them.

In this embodiment, by a pressing operation of the mode selecting switch 59, the mode according to the objects to be crushed of an object to be crushed which is any one of straw matting, a tire or a pallet can be selected. The energizing control for the solenoid 31 of the change-over valve 30 and the energizing control of the solenoids 34 and 35 of the direction control valve 16 are constituted to be performed corresponding to this mode selection. In order to realize this control, the crusher rotational speed (rotational speed of the cutter 10) corresponding to the objects to be crushed, and the crusher automatic cleaning time (normal rotation time and reverse rotation time of the cutter 10) are stored in the read only memory 33*a* in the controller 33 as the map, as shown in FIG. 9. By reading this map, each of the solenoids 31, 34 and 35 are controlled to attain a required rotational speed and rotating direction. When any of the mode according to the objects to be crushed is not selected, the crusher automatic cleaning dial 48 and the crusher speed dial 49 of the operating panel 39 are manually set, and selection of any of the crusher rotation automatic speed change (AUTO) switch 56, the crusher rotation Hi fixing switch 57, or the crusher rotation Lo fixing switch 58 of the multi monitor 44 is manually selected, whereby the manual mode based on the crusher rotation setting becomes possible.

Figure 5:
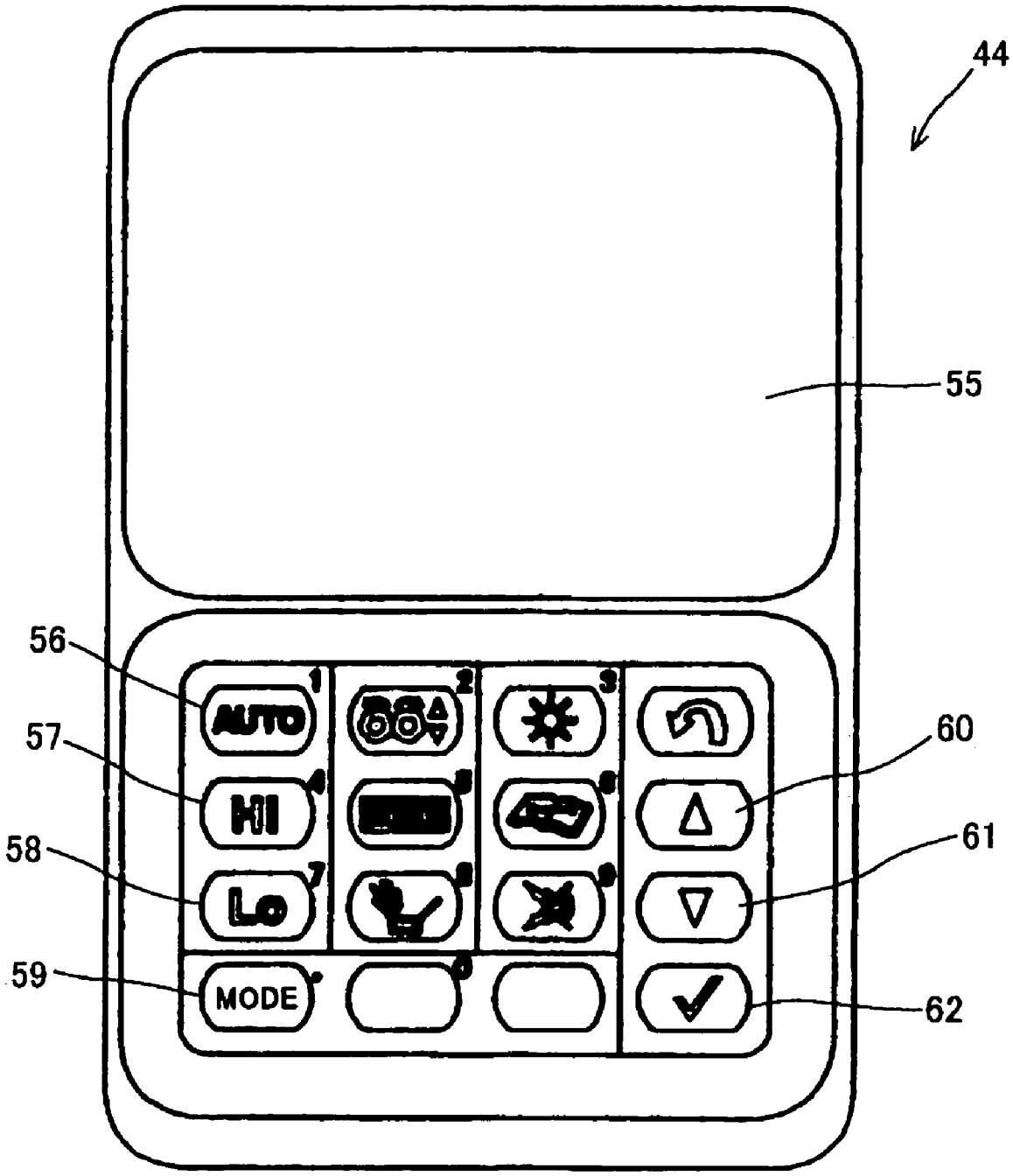
FIG. 5 is an enlarged view of a multi-monitor according to the embodiment.
Figure 6A:
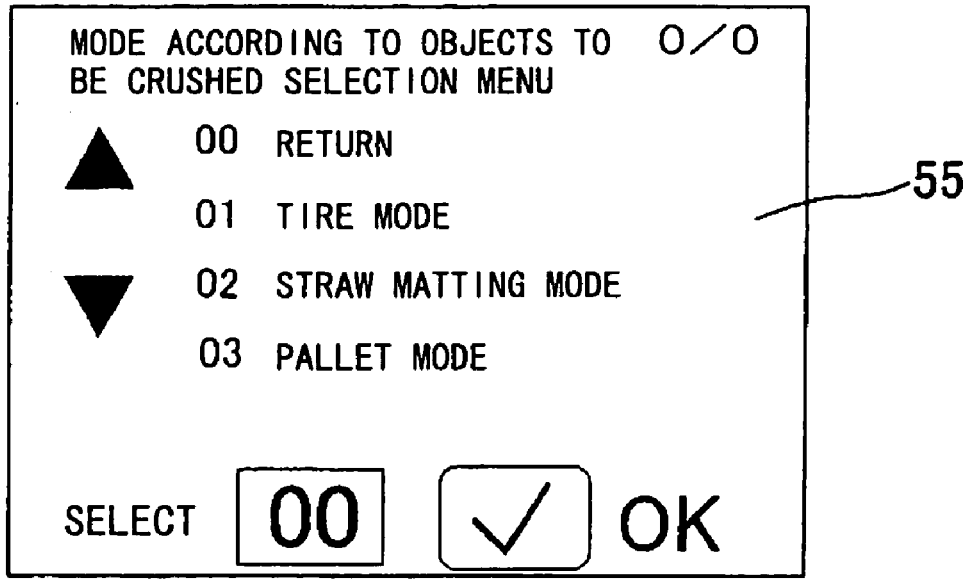
FIG. 6A and FIG. 6B are views showing monitor screen examples according to the embodiment.
Figure 6B:
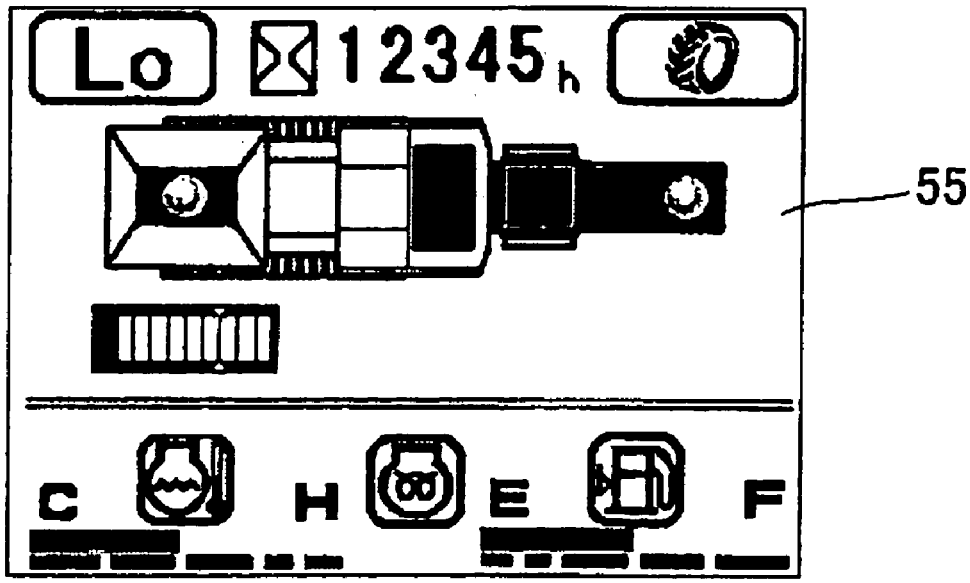

Next, an operation of the crushing control apparatus for the shearing crusher according to this embodiment will be explained. For example, when the object to be crushed is a tire, the operator performs an operation of pressing the mode selecting switch 59, and thereby the monitor screen 55 is switched to the mode according to the objects to be crushed selection menu screen as shown in FIG. 6A. Next, in this screen, a cursor (colored when selected) is put on the position of "01 tire mode" by operating an upper selection switch 60 or a lower selection switch 61 (see FIG. 5), or the numeric key is operated to enter the numeral corresponding to each mode according to the objects to be crushed, and then a confirmation switch 62 (see FIG. 5) is pressed, whereby the monitor screen 55 is switched to the tire mode screen as shown in FIG. 6B. In this tire mode screen, the pattern of a tire is displayed at the upper right, and it is displayed that the crusher rotational speed is fixed at Lo at the upper left. In the center of this screen, the operation condition, the load condition and the like of the crushing machine are displayed.

When the tire mode is selected by the mode selection switch 59 and the like, the selection signal is inputted into the controller 33. In the controller 33, the map data stored in the ROM 33*a* is read, and based on the read data, an energizing signal is transmitted to the solenoid 31 of the change-over valve 30. As a result, the change-over valve 30 is in the drain position 30*a*, the discharge oil pressure from the control hydraulic pump 29 is not supplied to the pressure receiving chamber 28 of the cylinder 26, the tilting angle of the swash plate 25 is set at large (the rotational speed of the crusher=Lo), and the hydraulic motor 12 is rotated at the rotational speed "Lo".

At the same time, based on the aforesaid map data, the energizing signal to energize the first solenoid 34 for 60 seconds and thereafter energize the second solenoid 35 for five seconds is transmitted to each of the solenoids 34 and 35 of the direction change-over valve 16 from the controller 33. As a result, the pair of rotary shafts 11 are rotated in the normal rotation direction at the time of normal rotation of the hydraulic motor 12, thereby crushing the objects to be crushed, and the rotary shafts 11 are rotated in the reverse rotation direction after a predetermined time (60 seconds in the above-describe example), whereby the crushed objects pressed into a clearance between the cutters 10 and a scraper (not shown) of the crusher 4 are dropped and discharged. Energizing time of each of the solenoids 34 and 35 are clocked by a timer included in the controller 33. The objects to be crushed, which are caught between the cutters 10 of the biaxial shearing crusher 4 and difficult to crush, are repeatedly crushed by the reverse rotation and clogging is prevented.

Figure 7A:
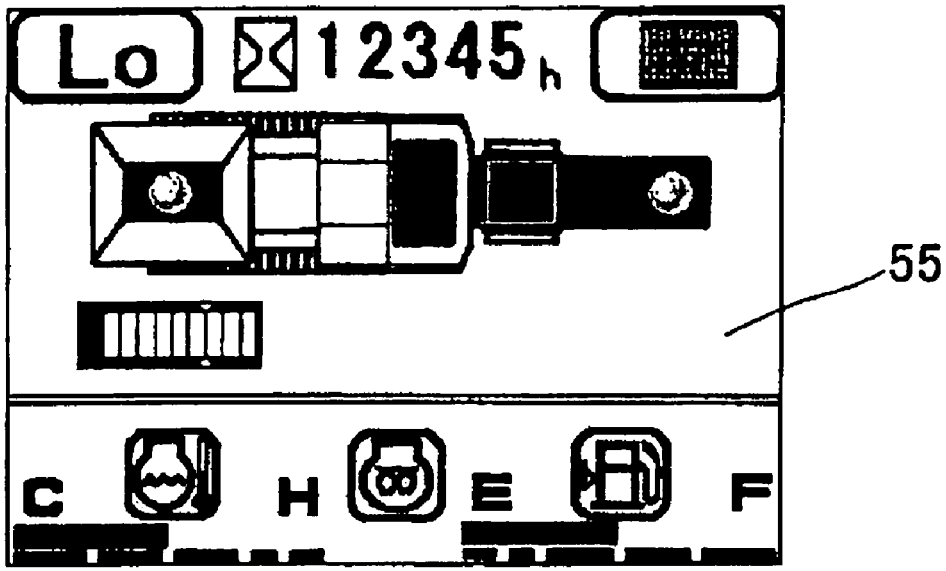
FIG. 7A and FIG. 7B are views showing other monitor screen examples according to the embodiment.

Meanwhile, when "02 straw matting mode" is selected in the mode according to the objects to be crushed selection menu screen shown in FIG. 6A, the screen is switched to the straw matting screen (the pattern of a straw mat is shown at the upper right) shown in FIG. 7A. In this case, based on the map data, the crusher rotation speed is fixed at Lo, the crusher normal rotation time is set at 30 seconds and the crusher reverse rotation time is set at five seconds, and each of the solenoids 31, 34 and 35 are controlled as in the aforesaid tire mode.

Figure 7B:
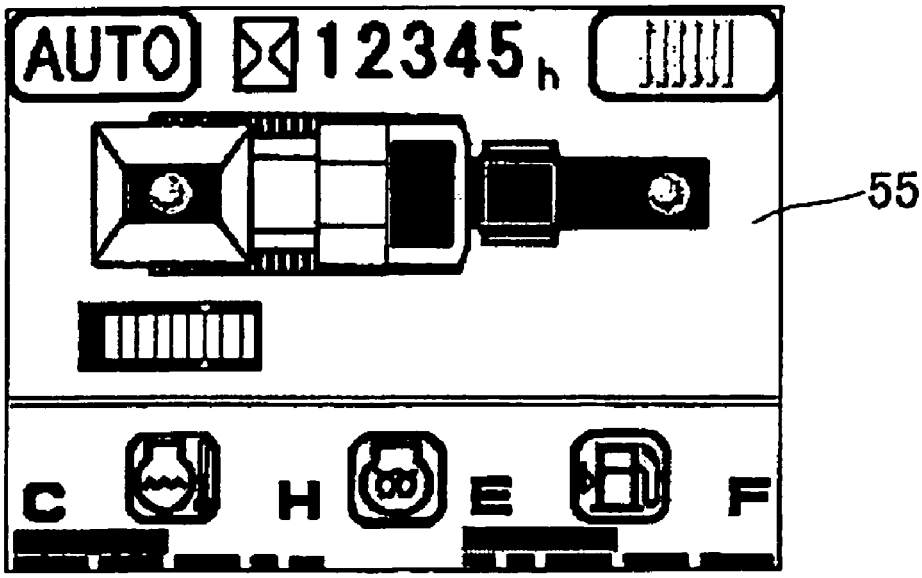

When "03 pallet mode" is selected in the mode according to the objects to be crushed selection menu screen, the screen is switched to the pallet mode screen with the pattern of a pallet being displayed on the upper right as shown in FIG. 7B. With this, the rotational speed of the crusher is set at "AUTO speed change" based on the map data. At the time of the AUTO speed change, the change-over valve 30 is controlled to switch by the controller 33 in accordance with the oil pressure of the first main circuit 17 detected by the first pressure sensor 36 and the second pressure sensor 37, as will be explained next.

Figure 8:
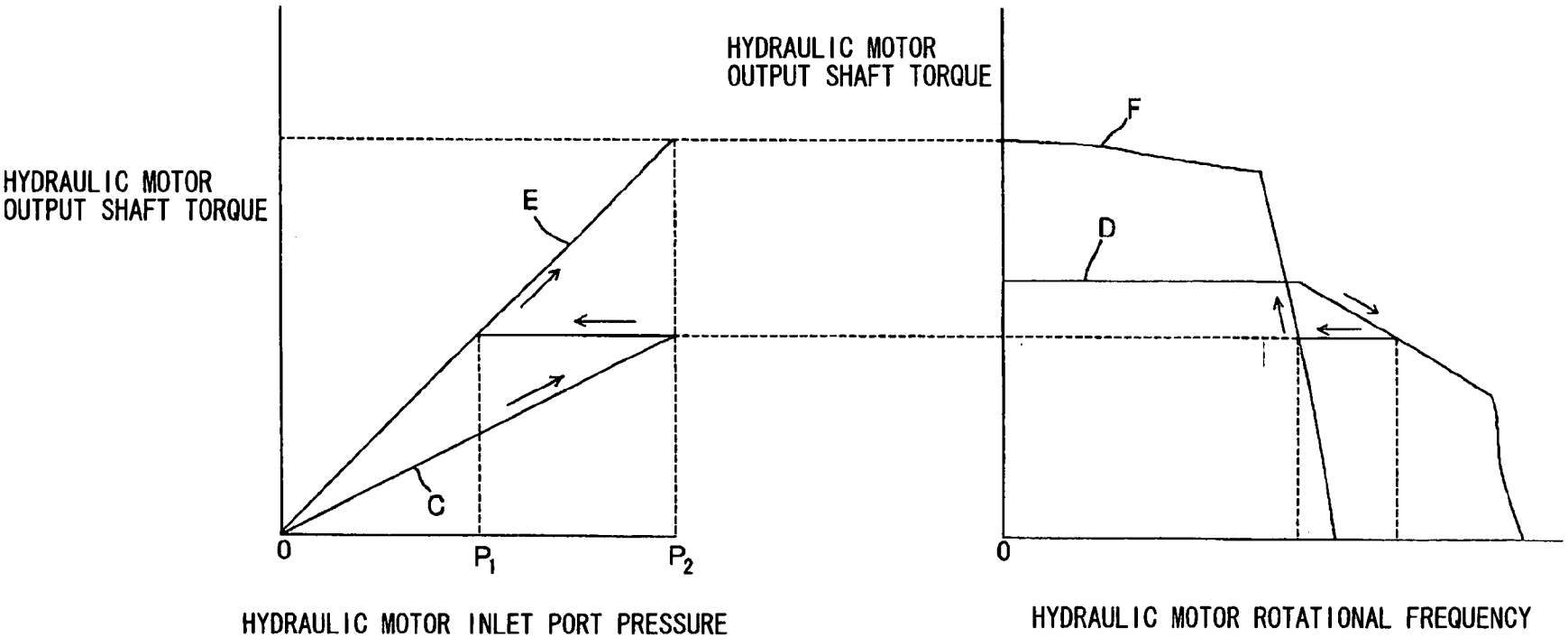
FIG. 8 is a graph showing relationship of hydraulic motor output shaft torque, hydraulic motor inlet port pressure and a hydraulic motor rotational frequency, according to the embodiment.

Here, it is assumed that the hydraulic motor 12 is rotated with the change-over valve 30 being switched into the supply position 30*b* and the tilting angle of the swash plate 25 being set to be small, for example. Since the flow amount of the pressure oil required for the hydraulic motor 12 to make one rotation is small, the hydraulic motor 12 is rotated at a high speed with small output shalt torque (see C and D in FIG. 8), and thus the crusher 4 is rotated at a high speed with low torque. At this time, the pressure of the first main circuit 17 is the first set pressure P1 (for example, 15 MPa) or higher, the second pressure sensor 37 at the low pressure side is ON.

When the load on the crusher 4 becomes large and the pressure of the first main circuit 17 becomes the second set pressure P2 (for example, 31 MPa), the first pressure sensor 36 at the high pressure side performs an ON operation. As a result, passage of electric current from the controller 33 to the solenoid 31 is shut off, and the change-over valve 30 is switched into the drain position 30*a*, which makes the tilting angle of the swash plate 25 large. As a result of this, the flow amount of the pressure oil required for the hydraulic motor 12 to make one rotation becomes large, the hydraulic motor 12 is rotated at a low speed with the output shaft torque being large (see E and F in FIG. 8), and the crusher 4 is rotated at a low speed with high torque. At this time, the pressure of the first main circuit 17 reduces to be lower than the second set pressure P2.

When the load of the crusher 4 decreases in this state, then the pressure of the first main circuit 17 is reduced to be lower than the first set pressure P1 and the second pressure sensor 37 at the low pressure side is OFF, the energizing signal is transmitted to the solenoid 31 from the controller 33, and the change-over valve 30 is switched into the supply position 30*b* to set the tilting angle of the swash plate 25 to be small. In this manner, the hydraulic motor 12 is rotated at a high speed with output shaft torque being small, and the crusher 4 is rotated at a high speed with low torque.

In this manner, the rotational speed of the hydraulic motor 12 is automatically switched to the Lo position and the Hi position in accordance with the pressure of the first main circuit 17, in other words, in accordance with the load of the crusher 4. In this pallet mode, wood which is a comparatively low load is handled, the crusher normal rotation time is set at 60 seconds, and the crusher reverse rotation time is set at five seconds, respectively.

As described above, according to this embodiment, the operator operates the mode selecting switch 59 and the like, and selects any one of the kinds of the objects to be crushed which are straw matting, a tire and a pallet, the control condition of the rotating shafts 11 for each mode, which is stored in the map in the controller 33 in accordance with the kinds of the objects to be crushed, is read out. Then, the rotational speed of the rotating shafts 11 and the normal and reverse rotation time are controlled, whereby the crusher 4 is always controlled to be under the optimal crushing condition (the rotational speed and the normal and reverse rotation time) in accordance with the kinds which are straw matting and a tire having a comparatively large factor of clogging, and a pallet being wood of light load with comparatively favorable crushability. As a result, stop of operation due to excessive load, clogging and the like can be reliably prevented. Accordingly, crushing efficiency can be enhanced, the operation of the operator is simple and easy, and in addition to this, stop of operation can be reliably prevented.

In this embodiment, the case in which the kind of the objects to be crushed is any one of straw matting, a tire or a pallet is explained, but the kinds of the objects to be crushed are not limited to these, and the other kinds of objects can be added and map data can be added corresponding to their qualities. In this embodiment, the crusher which shears and crushes the objects to be crushed by rotating a pair of rotary shafts opposing each other is explained, but the number of rotary shafts may be one, or three or more. Further, in this embodiment, the swash plate type hydraulic motor is used, but it goes without saying that the present invention is also applicable to a system having a bent axis type hydraulic motor.

What is claimed is:

1. A crushing control apparatus for a shearing crusher for shearing and crushing objects with cutters mounted on a plurality of rotatable rotary shafts, comprising:

mode selecting means for selecting one of a plurality of modes that correspond respectively to kinds of said objects to be crushed;

memory means for storing a control condition of said rotary shafts for each of said plurality of modes;

control means for reading out the control condition corresponding to the selected mode from said memory means, and for setting a rotation speed of said plurality of rotary shafts in accordance with the read out control condition; and a direction control valve for switching between a normal rotation direction and a reverse rotation direction of said hydraulic motor, wherein said kinds objects to be crushed comprise at least one of straw matting, a tire, and a pallet, wherein said control means controls a hydraulic motor for driving said rotary shafts, and wherein said control means controls a position of said direction control valve and a holding time in the position.

2. A crushing control apparatus for a shearing crusher for shearing and crushing objects with cutters mounted on a plurality of rotatable rotary shafts, comprising:

mode selecting means for selecting one of a plurality of modes that correspond respectively to kinds of said objects to be crushed;

memory means for storing a control condition of said rotary shafts for each of said plurality of modes; and control means for reading out the control condition corresponding to the selected mode from said memory means, for controlling the rotary shafts to alternate rotation between a normal rotation direction and a reverse rotation direction, and for setting a length of time that the rotary shafts rotate in the normal rotation direction and a length of time that the rotary shafts rotate in the reverse rotation direction in accordance with the read out control condition.

3. The crushing control apparatus for the shearing crusher according to claim 2, wherein said kinds objects to be crushed comprise at least one of straw matting, a tire, and a pallet; and wherein said control means controls a hydraulic motor for driving said rotary shafts.

4. The crushing control apparatus for the shearing crusher according to claim 3, further comprising:

a direction control valve for switching between a normal rotation direction and a reverse rotation direction of said hydraulic motor, corresponding respectively to the normal and reverse rotation directions of the rotary shafts, wherein said control means controls a position of said direction control valve and a holding time in the position.

* * * * *